US005331122A

United States Patent [19]

Winder

[11] Patent Number: 5,331,122

[45] Date of Patent: Jul. 19, 1994

[54] SAFETY LOCK OFF DEVICE

[76] Inventor: John R. Winder, P.O. Box 167564, Irving, Tex. 75016-7564

[21] Appl. No.: 942,617

[22] Filed: Sep. 10, 1992

[51] Int. Cl.[5] ..... H01H 9/28

[52] U.S. Cl. ..... 200/43.19; 200/43.14; 200/43.21

[58] Field of Search ..... 200/43.15, 43.14, 43.19, 200/43.21

[56] References Cited

U.S. PATENT DOCUMENTS

| | | | |
|---|---|---|---|
| 2,795,663 | 6/1957 | Estes | 200/43.21 |
| 2,849,552 | 8/1958 | Firestone | 200/43.15 |
| 2,937,248 | 5/1960 | Michetti . | |
| 3,783,215 | 1/1974 | Brumfield . | |
| 4,581,502 | 4/1986 | Gradstuskas | 200/43.16 |
| 4,978,816 | 12/1990 | Castonguay et al. | 200/43.14 |
| 5,079,390 | 1/1992 | Costanzo et al. | 200/43.14 |
| 5,122,624 | 6/1992 | Benda | 200/43.14 |
| 5,147,991 | 9/1992 | Jordan, Sr. | 200/43.14 |
| 5,148,910 | 9/1992 | Williams | 200/43.19 |
| 5,165,528 | 11/1992 | Kozlowski et al. | 200/43.15 |

FOREIGN PATENT DOCUMENTS

| | | | |
|---|---|---|---|
| 182143 | 2/1918 | Canada | 200/43.15 |

*Primary Examiner*—Renee S. Luebke
*Attorney, Agent, or Firm*—John L. Palmer

[57] ABSTRACT

A safety lock device for a toggle switch has a cylindrical head with slotted opening in its perimeter, a threaded outer surface, flared skirt and an open base. Vice arms are attached within the device with its arms protruding through its slotted perimeter. The vice arms have opposed, grooved heads spaced within the open base. A lock ring with teeth on its inner surface and a plurality of screw holes through its upper surface, slides over the cylindrical head with the teeth in the slotted outer perimeter of the cylindrical head. The lock ring forces the grooved heads into a clamping position of the toggle switch. A flanged lock nut with a hole in its flange is threaded to mate with the cylindrical head and lock ring. The hole in the flange is aligned with one of the screw holes of the lock ring and a screw is inserted into the aligned holes to lock the device in locking position.

6 Claims, 1 Drawing Sheet

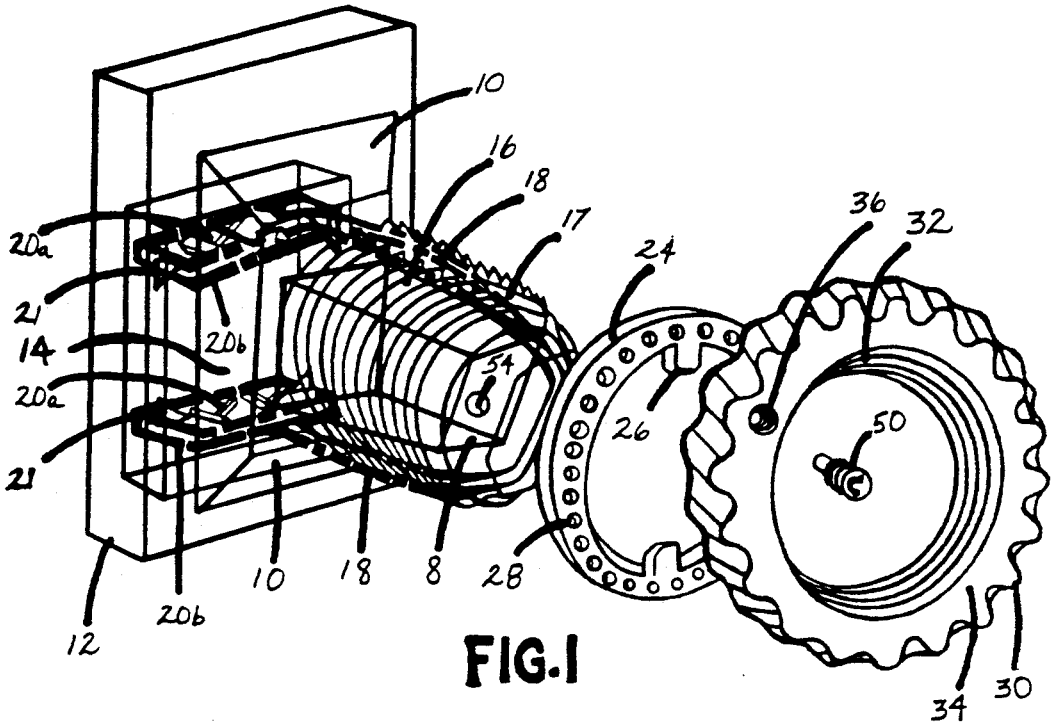
FIG.1
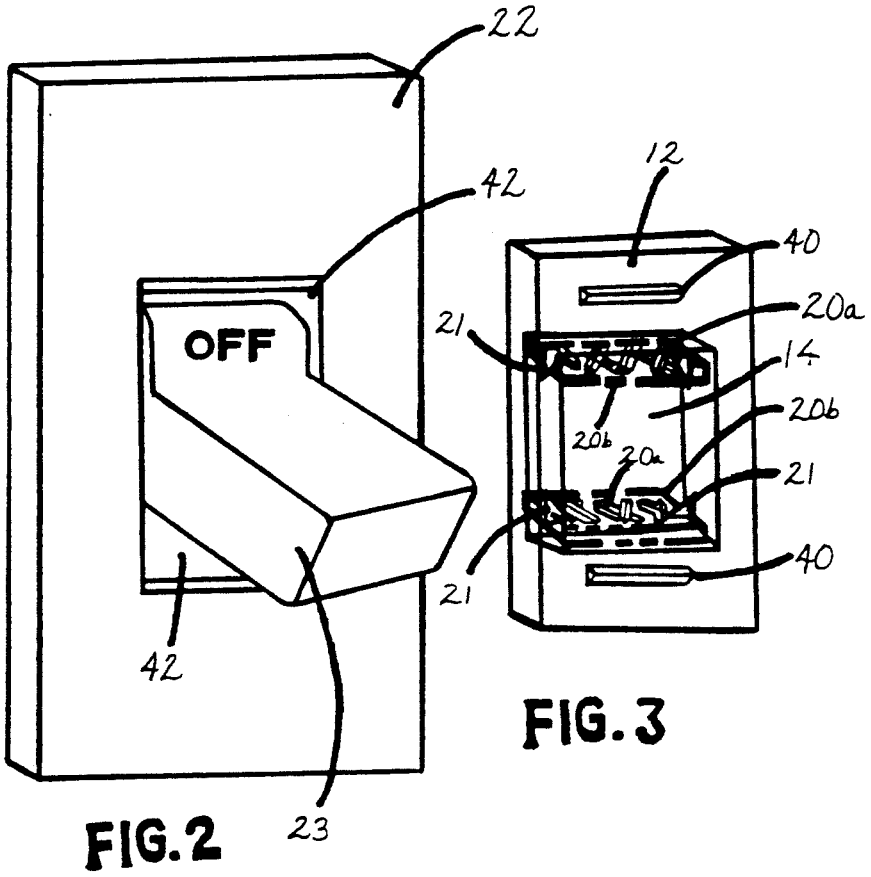
FIG.2
FIG.3

SAFETY LOCK OFF DEVICE

This invention relates to a lock device for a toggle switch to lock the switch in an OFF position.

BACKGROUND OF THE INVENTION

In circumstances where it becomes necessary to insure that a toggle switch is to be maintained in its OFF position, it is advantageous to provide means to lock the switch in such position rather than disconnecting a main breaker or feeder circuit. Locking devices for toggle switches are known in the prior art. See for example U.S. Pat. Nos. 2,795,663 and 5,147,991. Such devices use a clamp that fits over the toggle switch and may be secured in position, generally by a padlock, or a screw bolt. Other prior art devices use side windows, latches and color codes to indicate that the switch is to be maintained in a fixed position.

SUMMARY OF THE INVENTION

My invention is a safe lock for a toggle switch that has a cylindrically formed head and flared body, attached to a flat base plate that is shaped to fit flush against a toggle switch cover plate. The cylindrical head and flared body are hollow and the cylindrical head has a slotted perimeter that is threaded on its outer perimeter. The base is open in its center portion.

Vice arms are located within the device and are joined at the top of the cylindrical head. The vice arms fit into the slotted open perimeter and protrude beyond the perimeter surface. The vice arms have grooved, parallel surface heads that are within the flared body and are adjacent to the bottom of the base at its open portion. The grooved heads are rectangular with sharp angles positioned at its center end which are canted to contact the switch and lock it in its off position.

I provide a lock ring and mating lock nut for the device, as shown in FIG. 1. The lock ring has two teeth in its inner circumference and a plurality of screw holes on its surface. The lock ring slides down over the slotted perimeter head with the teeth in contact with the vice arms, thereby, forcing the vice arms into clamping position in which the grooved heads contact the toggle switch pole. The lock nut is threaded, with a flange that has at least one hole through the flange. The lock nut screws onto the threaded perimeter of the cylindrical head and fits over the lock ring. Its hole aligns with one of the lock ring holes. When screwed thereon the lock ring-lock nut combination compresses the vice arms into a clamping position, and the sharp angles on the vice heads cut into the switch pole.

On the base I provide two position guides that fit into the opening between the switch cover plate where the toggle switch protrudes through. They align the device for a flush fit with the cover plate and guide the device into an interlocking position with the toggle switch. For locking means, a screw is inserted in the aligned holes of the lock ring-lock nut. I prefer that a special tool be provided, such as an off-size allen wrench to insert the screw, so that a person without such tool may not alter the locked position of the device.

BRIEF DESCRIPTION OF THE DRAWINGS

FIG. 1 is an exploded view of my invention.

FIG. 2 is a view of a typical toggle switch and switch cover plate.

FIG. 3 is a bottom view of the device.

DETAILED DESCRIPTION

Refer first to FIG. 1. In FIG. 1, I show an exploded view of my invention, which has a cylindrical head 8 and a flared bottom section 10. The flared section 10 terminates at a base plate 12, which is preferably rectangular in shape. The device is hollow within the cylindrical head 8, flared section 10, and a portion of the base plate 12 is cut away, or open at 14, making the device hollow to the top of the cylindrical head 8. The perimeter of the cylindrical head 8 is threaded at 16, and opposite slotted openings 17 into the hollow inside thereof.

Vice arms 18 are positioned within the cylindrical head 8 and flared section 10. The vice arms 18 are attached to the inner top of the cylindrical head 8, with arms that protrude through the openings 17. The vice arms 18 have surface grooved vice head 8 with their ends angularly sharpened at 21 that are approximately even with the opening 14 of the base plate 12. The base plate 12 fits flush against a switch cover plate 22 for a toggle switch 23, that is to be locked in position. The cover plate 22 and toggle switch 23 are shown in FIG. 2.

I provide a lock ring 24, shown in FIG. 1, which is circular in shape and may have two teeth 26 within its inner circumference, and a plurality of screw holes 28 on its surface. The teeth 26 fit into the slotted opening 17 on the perimeter of the cylinder head 8 so that the lock ring 24 will slide down along the surface of the cylindrical head 8 and contact the protruding portions of the vice arms 18. When it is slid over the vice arms 18, it compresses the grooved vice heads **20*a*, 20*b* into contact with the switch 23**.

Referring again to FIG. 1, I provide a lock nut 30 with a threaded inner surface 32 to match the threaded perimeter 16 of the cylindrical head 8. The lock nut 30 has a flange 34 on its upper surface with at least one hole 36 therein. The lock nut 30 is to be screwed onto the cylindrical head 8, where it contacts and further compresses the vice arms 18 into a clamping position of the switch 23. In such position, the grooved surfaces **20*a*, 20*b* and the angles 21 clamp onto the toggle switch pole 23**.

In FIG. 3, I show position guides 40 located on the bottom surface of the base plate 12, which fit into crevices 42 where the toggle switch 23 protrudes through the switch cover 22, shown in FIG. 2. These guides 40 position the device to fit the switch cover 22 in a proper position to lock the device wherein the surface grooved vice heads **20*a*, 20*b* properly contact the toggle switch pole 23 to lock it into the off position. The sharp angled ends 21 cut into the surface of the switch pole 23 (the switch pole is generally made of plastic). This prevents one from sliding a thin object under the device from the side to pry it from the switch pole 23**.

I provide a screw 50 that is to be inserted into the hole 36. I prefer that a tool and screw hole of noncommercial availability be used. As an additional safety precaution, I provide a hole 54 at the end of the device where a flag may be attached. Such flag makes the device readily noticeable when in use.

I have described my invention within the provisions of the patent statutes, and it is to be understood that various modifications may be made in my invention without departing from the spirit of my invention.

I claim:

1. A safety lock device for a toggle switch that has a cover plate with an area through which a toggle switch actuator protrudes, the device locks the switch in an off position, and comprises:

a hollow cylindrical head having, two slotted openings and a threaded outer surface, a flared skirt and a base plate attached thereto, said base plate having an open center;

two vice arms attached within said open cylinder head and having opposed grooved vice heads at an end of each arm adjacent to said base plate opening, said vice arms being shaped to protrude through said slotted openings;

alignment guides on said base plate positioned to fit into the area of the cover plate where the toggle switch actuator protrudes for aligning the device on the cover plate;

a circular lock ring having two teeth in its inner circumference and a plurality of screw holes through its flat surface , said lock ring being sized to slide over said cylindrical head with said teeth on said vice arms for compressing said vice arms;

a lock nut threaded onto said cylindrical head and having a flange thereon with a hole alignable with one of said screw holes when threaded thereon, and a screw inseratable into said aligned holes.

2. The safety lock device of claim 1 in which;

an attachment point is provided for a warning flag to be attached to said device.

3. The safety lock device of claim 1 in which;

said heads of said vice arms have sharpened end portions that cut into the switch actuator when moved into locking position.

4. A safety lock device for a toggle switch that has a cover plate through which a toggle switch actuator protrudes, the device comprises;

a hollow cylindrical head having a threaded outer surface with slotted openings, a flared skirt and an open base plate attached thereto;

vice arms positioned within said cylindrical head and extending through slotted openings, and extending toward said open base plate;

opposed grooved heads on said vice arms positioned at said open base plate to engage the switch actuator when said device is in locking position;

a lock ring having guide means to position it onto said cylindrical head and in contact with said vice arms to force said vice arms into locking position, and a plurality of screw holes through its flat surfaces;

a lock nut threaded over said outer surface to mate with said lock ring, said lock nut having a hole alignable with one of the screw holes of said lock ring when in locking position, and a screw inserted into said aligned holes to lock the device in place.

5. The device of claim 4 in which;

the opposed grooved heads have sharp ends that cut into the switch actuator when compressed into locking position.

6. The device of claim 5 in which;

the base plate has guides to locate the device on the switch cover plate to be in correct locking position.

* * * * *